US005434924A

United States Patent [19]

Jampolsky

[11] Patent Number: 5,434,924

[45] Date of Patent: Jul. 18, 1995

[54] HEARING AID EMPLOYING ADJUSTMENT OF THE INTENSITY AND THE ARRIVAL TIME OF SOUND BY ELECTRONIC OR ACOUSTIC, PASSIVE DEVICES TO IMPROVE INTERAURAL PERCEPTUAL BALANCE AND BINAUARAL PROCESSING

[75] Inventor: Arthur Jampolsky, Marin County, Calif.

[73] Assignee: Jay Management Trust, Belvedere, Calif.

[21] Appl. No.: 666,477

[22] Filed: Mar. 6, 1991

Related U.S. Application Data

[63] Continuation of Ser. No. 48,577, May 11, 1987, abandoned.

[51] Int. Cl.[6] ..... H04R 25/00

[52] U.S. Cl. ..... 381/68.4; 381/17; 381/23.1; 381/25; 381/68; 381/68.2; 381/68.3; 381/68.5

[58] Field of Search ..... 128/731; 381/68.4, 68.1, 381/68.5, 68.7, 68, 69, 23.1, 28, 68.2, 68.3, 17, 25

[56] References Cited

U.S. PATENT DOCUMENTS

| | | | |
|---|---|---|---|
| 2,266,669 | 12/1941 | Wengel | 381/23.1 |
| 2,390,794 | 12/1945 | Knight | 381/68 |
| 2,896,024 | 7/1959 | Toomey | 381/68.4 |

(List continued on next page.)

FOREIGN PATENT DOCUMENTS

| | | | |
|---|---|---|---|
| 0100153 | 2/1984 | European Pat. Off. . | |
| 1067128 | 6/1954 | France . | |
| 2323437 | 11/1974 | Germany | 381/68.1 |
| 0153698 | 8/1985 | Japan | 381/68.1 |
| 61-56600 | 3/1986 | Japan | 381/68 |

OTHER PUBLICATIONS

Qualitone, "Genesis", Hearing Instruments, Nov. 1987.
Hiramatsu, Takeyoshi, "Narrow Angle of Directivity Hearing Aid", 1985.
Mazda, "Electronics Engineer's Reference Book" p. 36/4 1985.

(List continued on next page.)

*Primary Examiner*—Curtis Kuntz
*Assistant Examiner*—William Cumming
*Attorney, Agent, or Firm*—David Pressman

[57] ABSTRACT

A hearing aid for a person with asymmetric hearing perception (a weaker ear system and a better ear system) employs conventional frequency-selective amplification (26L) of sound coming to the weaker ear's system and frequency selective amplitude adjustment (32) and arrival time adjustment (retardation or relative advancement) (34) of sound coming to the better ear's system so that its resultant characteristics match those of the weaker ear's system, as aided, or even without aiding the weaker ear's system. As a result, sound perceived by both ear systems is matched or balanced, at each frequency, in both arrival time and amplitude. Such interaural balancing effects a great improvement in the binural processing mechanism, which in turn increases speech perception, especially in the presence of general noise or adjacent localized noise sources. The aid may be implemented by a pair of microphones (24L, 24R), one for each ear's system. The signal from the microphone to the weaker ear's system includes a conventional variable gain amplifier (26L) and a conventional frequency selective filter (13) to provide tailored amplification of the sound to the weaker ear's system, insofar as possible. Also the channel to the weaker ear's system includes a fixed delay (28) to compensate for a delay in the channel to the better ear's system. The signal from the microphone to the better ear's system includes a variable gain amplifier (26R) and a set of bandpass filters (30) to cover the audio spectrum in discrete steps. Each filter is connected in series with a selected attenuator (32) and a selected time delay (34) so as to match the perceived arrival time and amplitude level at its band with that of the weaker ear's system.

54 Claims, 8 Drawing Sheets

U.S. PATENT DOCUMENTS

| | | | |
|---|---|---|---|
| 2,920,138 | 1/1960 | Fogel | 381/25 |
| 2,930,858 | 3/1960 | Hollingsworth | 381/23.1 |
| 2,972,018 | 11/1961 | Hawley et al. | 381/71 |
| 3,125,646 | 3/1964 | Lewis | 381/68.5 |
| 3,183,312 | 5/1965 | Salomon et al. | 381/68.3 |
| 3,504,120 | 3/1970 | Levitt | 381/25 |
| 3,509,289 | 4/1970 | Briskey et al. | 381/68.4 |
| 3,770,911 | 11/1973 | Knowles et al. | 381/68.1 |
| 3,784,750 | 1/1974 | Stearns et al. | 381/68 |
| 3,787,643 | 1/1974 | Nielsen | 381/68.4 |
| 3,894,195 | 7/1975 | Kryter | 381/68.4 |
| 3,894,196 | 7/1975 | Briskey | 381/68.4 |
| 3,901,215 | 8/1975 | John | 128/731 |
| 4,021,611 | 4/1976 | Tomatis | 179/1 N |
| 4,087,631 | 5/1978 | Yamada et al. | 381/25 |
| 4,143,244 | 3/1979 | Iwahara | 381/25 |
| 4,181,818 | 1/1980 | Shenier | 381/23.1 |
| 4,329,544 | 5/1982 | Yamada | 381/17 |
| 4,366,349 | 12/1982 | Adelman | 179/107 FD |
| 4,392,547 | 7/1983 | Baker | 181/135 |
| 4,449,018 | 5/1984 | Stanfon | 381/23.1 |
| 4,495,637 | 1/1985 | Bruney | 381/1 |
| 4,515,169 | 5/1985 | Ward | 128/746 |
| 4,517,415 | 5/1985 | Laurence | 381/68.4 |
| 4,531,229 | 7/1985 | Coulter | 381/68 |
| 4,536,844 | 8/1985 | Lyon | 381/68.2 |
| 4,556,069 | 12/1985 | Dalton, Jr. et al. | 128/746 |
| 4,589,128 | 5/1986 | Pfleiderer | 381/25 |
| 4,625,326 | 11/1986 | Kitzen et al. | 381/17 |
| 4,672,569 | 6/1987 | Genuit | 381/68 |
| 4,731,850 | 3/1988 | Levitt et al. | 381/68.2 |
| 4,751,738 | 6/1988 | Widow et al. | 381/68.1 |
| 4,773,095 | 9/1988 | Zwicker et al. | 381/68.1 |
| 4,868,880 | 9/1989 | Bennett, Jr. | 381/68.2 |
| 4,887,299 | 12/1989 | Cummins et al. | 381/68.4 |
| 5,046,102 | 9/1991 | Zwicker et al. | 381/68.2 |

OTHER PUBLICATIONS

Tele-Cros-Patented Wireless CROS by Telex Specification Sheet, Nov. 1975 Form No. HA-2368.

Hearing Instruments Products and Policies of Telex Communications, Inc. Jun. 1986.

Tremaine, "Audio Cyclopedia", pp. 1146-1150, Mar. 1977.

Hable, Brown, Gudmundsen, "CROS-PLUS: A Physical CROS System", Hearing Instruments, vol. 41, #8, 1990.

EVALUATION SYSTEM

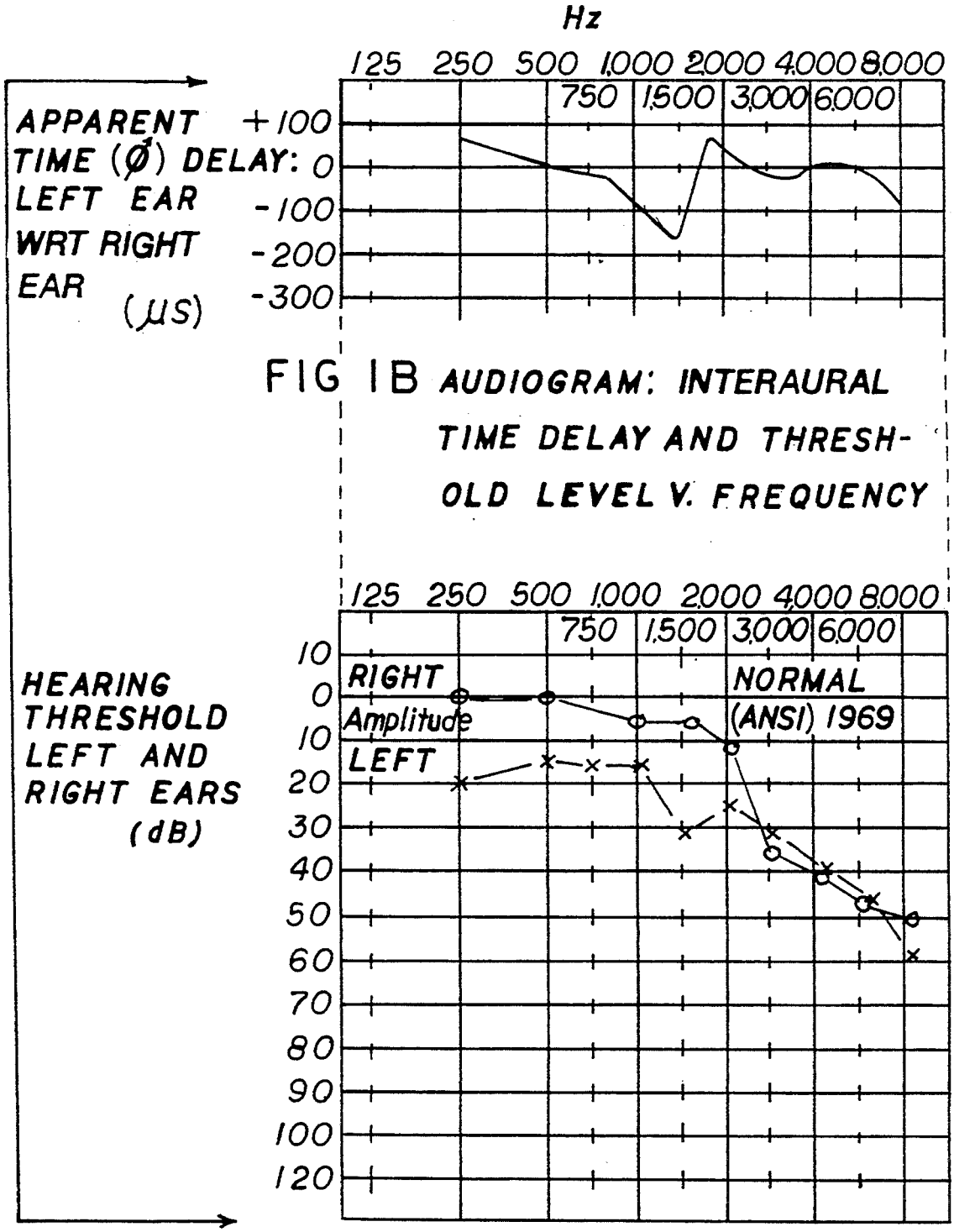
FIG 1B AUDIOGRAM: INTERAURAL TIME DELAY AND THRESHOLD LEVEL V. FREQUENCY

| | FREQUENCY | db Δ Amp. | μsec Δ Dly | | |
|---|---|---|---|---|---|
| | 250 | -20 | 70 | | |
| | 314 | -17 | 50 | | |
| | 390 | -14 | 20 | | |
| | 500 | -15 | 0 | | |
| | 629 | -13 | -10 | | |
| | 793 | -12 | -20 | | |
| | 1000 | -10 | -100 | | |
| | 1529 | -20 | -150 | | |
| | 1587 | -23 | -30 | | |
| | 2000 | -15 | 40 | | |
| | 2519 | -10 | 10 | | |
| | 3174 | +3 | -20 | | |
| | 4000 | 0 | 0 | | |
| | 5039 | 0 | 10 | | |
| | 6349 | -3 | -5 | | |
| | 8000 | -10 | -100 | | |
| | | | | | |

FIG 1C — VALUES: INTERAURAL TIME DLY. & ATTENUATION MEASURED IN FIGS 1 & ASSIGNED TO ATTENUATORS & DELAY UNITS OF FIG 2

BLOCK DIAGRAM OF HEARING AID
(* = ± 1/6 OCTAVE)

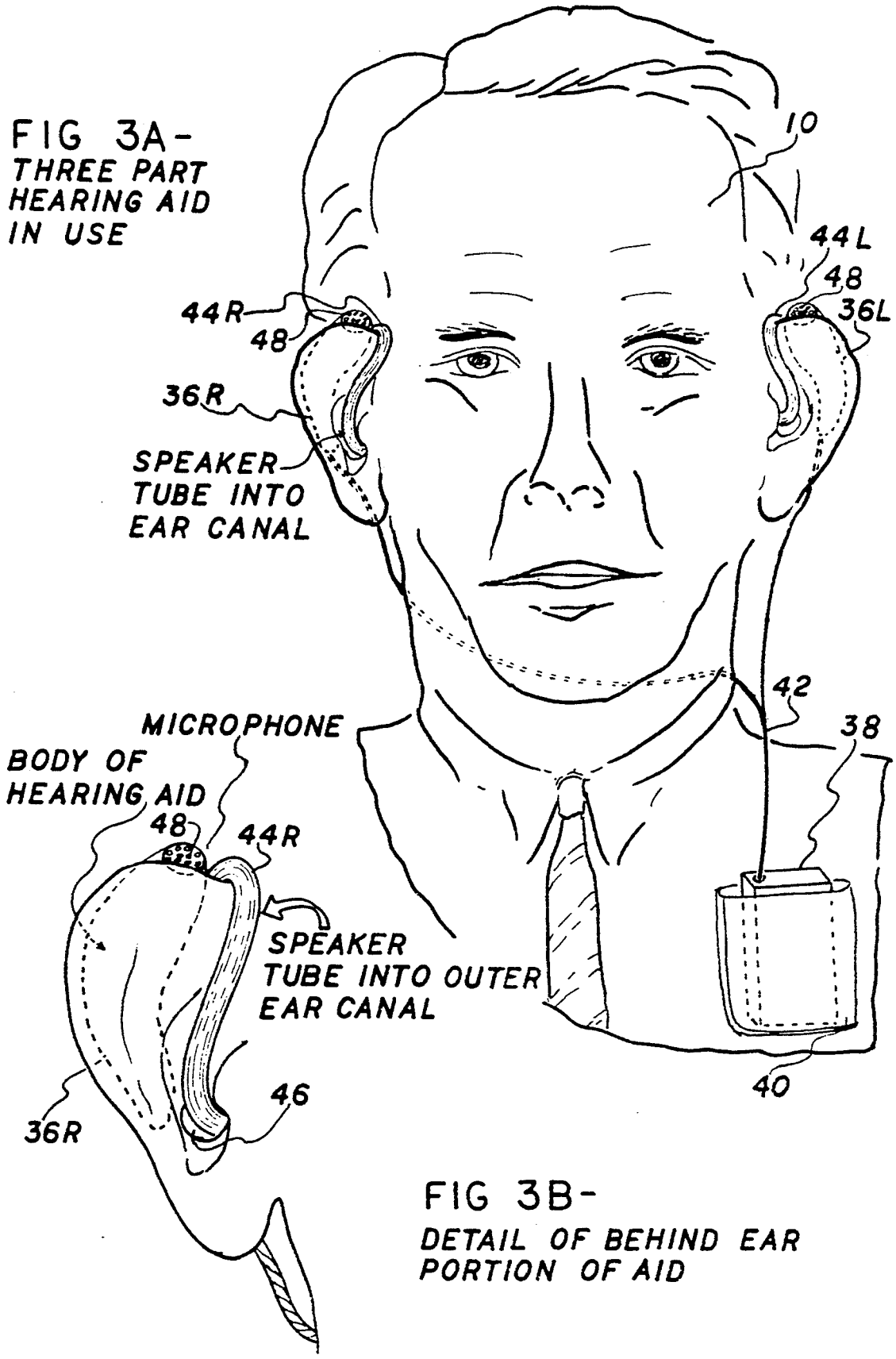
FIG 3A- THREE PART HEARING AID IN USE
FIG 3B- DETAIL OF BEHIND EAR PORTION OF AID

COMPONENT PLACEMENT DIAGRAM USING SEPARATE CONTROL BOX

COMPONENT
PLACEMENT
DIAGRAM (TWO PART HEARING AID)

VERSION
IN GLASSES

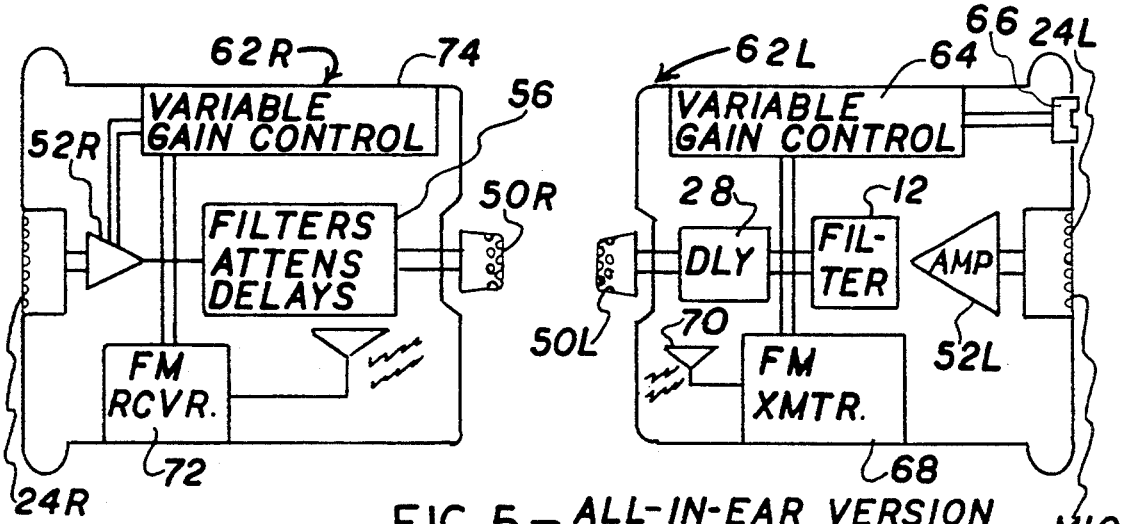
FIG 5 – ALL-IN-EAR VERSION USING R.F. CONTROL
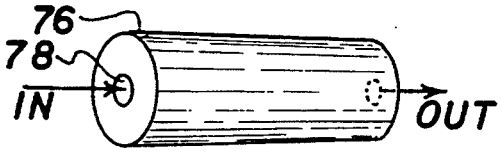
FIG 6A - PASSIVE AID
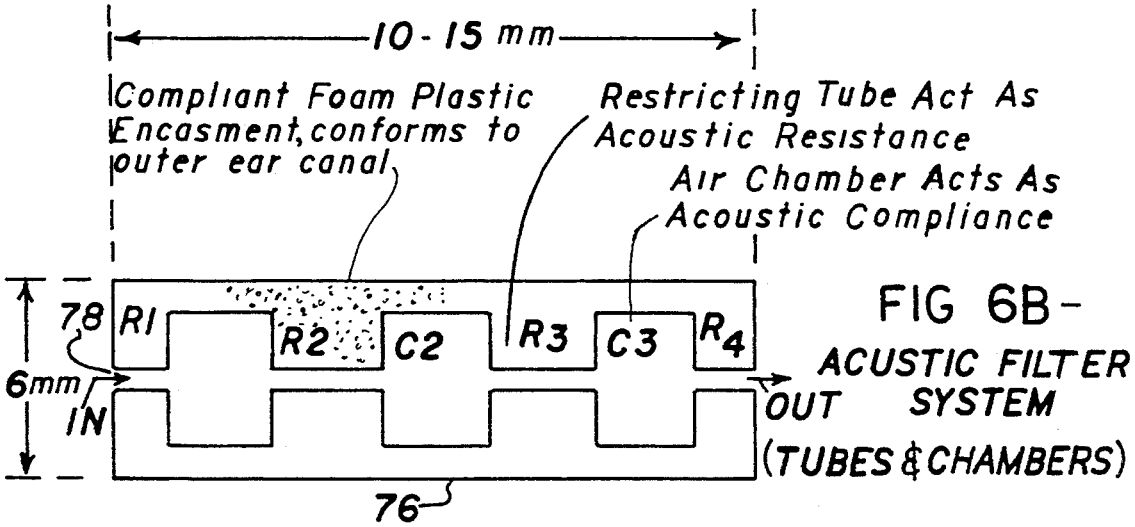
FIG 6B - ACUSTIC FILTER SYSTEM (TUBES & CHAMBERS)
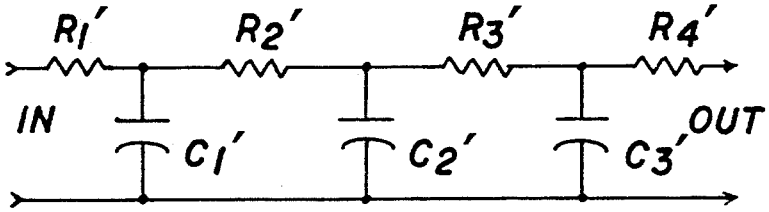
FIG 6C - EQUIVALENT ELECTRICAL CIRCUIT

HEARING AID EMPLOYING ADJUSTMENT OF THE INTENSITY AND THE ARRIVAL TIME OF SOUND BY ELECTRONIC OR ACOUSTIC, PASSIVE DEVICES TO IMPROVE INTERAURAL PERCEPTUAL BALANCE AND BINAUARAL PROCESSING

BACKGROUND—CROSS-REFERENCE TO RELATED APPLICATION

This patent is a continuation of U.S. application Ser. No. 07/048,577, filed May 11, 1987, now abandoned.

BACKGROUND—FIELD OF INVENTION

This invention relates to hearing, particularly to a hearing aid which operates in a seemingly paradoxical manner and which can improve the hearing of a hearing-impaired person to a greater extent than heretofore possible.

BACKGROUND—DESCRIPTION OF PRIOR ART

Heretofore persons with hearing impairments (hereinafter "patients") were able to improve their hearing somewhat by a variety of means, all of which had one or more significant disadvantages.

The most primitive means, which existed from time immemorial, was to cup a hand behind the ear and face the desired direction. The cupped hand conducted the desired sounds to the ear and excluded undesired sounds, thereby effecting a slight improvement in hearing. However this method had serious disadvantages: it was awkward to hold one's hand over the ear and the improvement effected was very slight.

Another primitive means was the passive ear trumpet or horn. This consisted of a conical tube, the narrow end of which was held against the ear so that it could conduct desired sounds directly to the ear while excluding undesired sounds. The disadvantages of this device were its size, weight, and awkwardness, as well as the fact that the improvement in hearing which it effected was still very slight.

Other passive devices were and still are also available, and although they lacked some of the disadvantages of the cupped hand and the ear trumpet, they still effected only a slight improvement in hearing.

With the advent of electronic amplifiers, starting with those employing vacuum tubes and then transistors, patients were and still are able to obtain electronic hearing aids which provided a far greater and far less awkward means of hearing improvement. These devices at first consisted of a microphone and an electronic amplifier which was carried on the body, such as in a pocket in the chest area, behind the ear, or in eyeglasses, and an earplug speaker which was connected to the output of the amplifier by a pair of wires.

The amplifiers in these original devices had a gain or amplification factor which was linear, i.e., uniform over the entire audio frequency range. Thereafter, and to this day, such amplifiers were improved by providing them with frequency selective filters so that they had a nonlinear amplification factor tailored to the patient's hearing curve. I.e., the gain v. frequency characteristic of the amplifier in the aid was tailored to the specific hearing impairment curve of the patient, usually by providing greater gain at higher frequencies, where hearing loss usually took place.

While such electronic hearing aids, particularly the non-linear type, effected a great improvement in hearing, they still had disadvantages. Despite the ability to provide virtually unlimited gain at any frequency range, electronic hearing aids still were able to restore the hearing of most patients to a relatively limited extent. Thus even when they wore nonlinear hearing aids with properly-tailored characteristics, their hearing was still far inferior to persons with "normal" hearing, especially in the presence of noise.

Specifically, patients' speech perception was poor, especially in the presence of general surrounding noise, such as at a party, in a moving vehicle, and in a room with other general surrounding audio noise, such as a transportation station or cafeteria. Also their ability to "selectively attend" was very limited. I.e., they were not able, even with the use of their hearing aids, to hear optimally in a directionalized manner so that, e.g., they had difficulty understanding a speaker or other sound source coming from a specific direction in the presence of one or more other, interfering and undesired sounds coming from different directions.

OBJECTS AND ADVANTAGES

Accordingly, several objects and advantages of the invention are to provide a hearing aid which restores hearing of a patient to a significantly greater extent than heretofore available, which is not awkward to use, which can greatly improve a patient's speech perception and understanding, especially in the presence of general surrounding noise, which can enable a patient to "selectively attend" to a greater extent than heretofore possible, and which can enable a patient to improve exclusion of unwanted sounds.

Additional objects and advantages are to provide a hearing aid which employs a new principle of operation, which takes into account new discoveries about hearing which I have made, which has an ostensibly paradoxical mode of operation, which can restore or create balanced hearing for the two ears of a patient, which can increase binural processing of the hearing of a patient, and which can be more precisely tailored to the hearing characteristics of the hearing impaired.

Further objects and advantages will become apparent from a consideration of the ensuing description and accompanying drawings.

DRAWING FIGURES

FIG. 1A is a hearing evaluation system for evaluating the hearing characteristics of a patient according to the invention. FIG. 1B is an audiogram which represents the hearing characteristics of the patient of FIG. 1A. FIG. 1C is a tabulation of these characteristics; these are used in the hearing aid of FIG. 2.

FIG. 3A is a view of a patient wearing a three-part hearing aid according to the invention. FIG. 3B is a detailed external view of a behind-the-ear part of this hearing aid.

FIG. 5 is a component placement view of a wireless two-part hearing aid according to the invention.

FIG. 6A is an external perspective view of a passive hearing aid according to the invention. FIG. 6B is a cross-sectional view of the aid of FIG. 6A.

FIG. 6C is an electrical equivalent diagram of the aid of FIG. 6A.

DRAWING REFERENCE NUMERALS

Figure 1A:
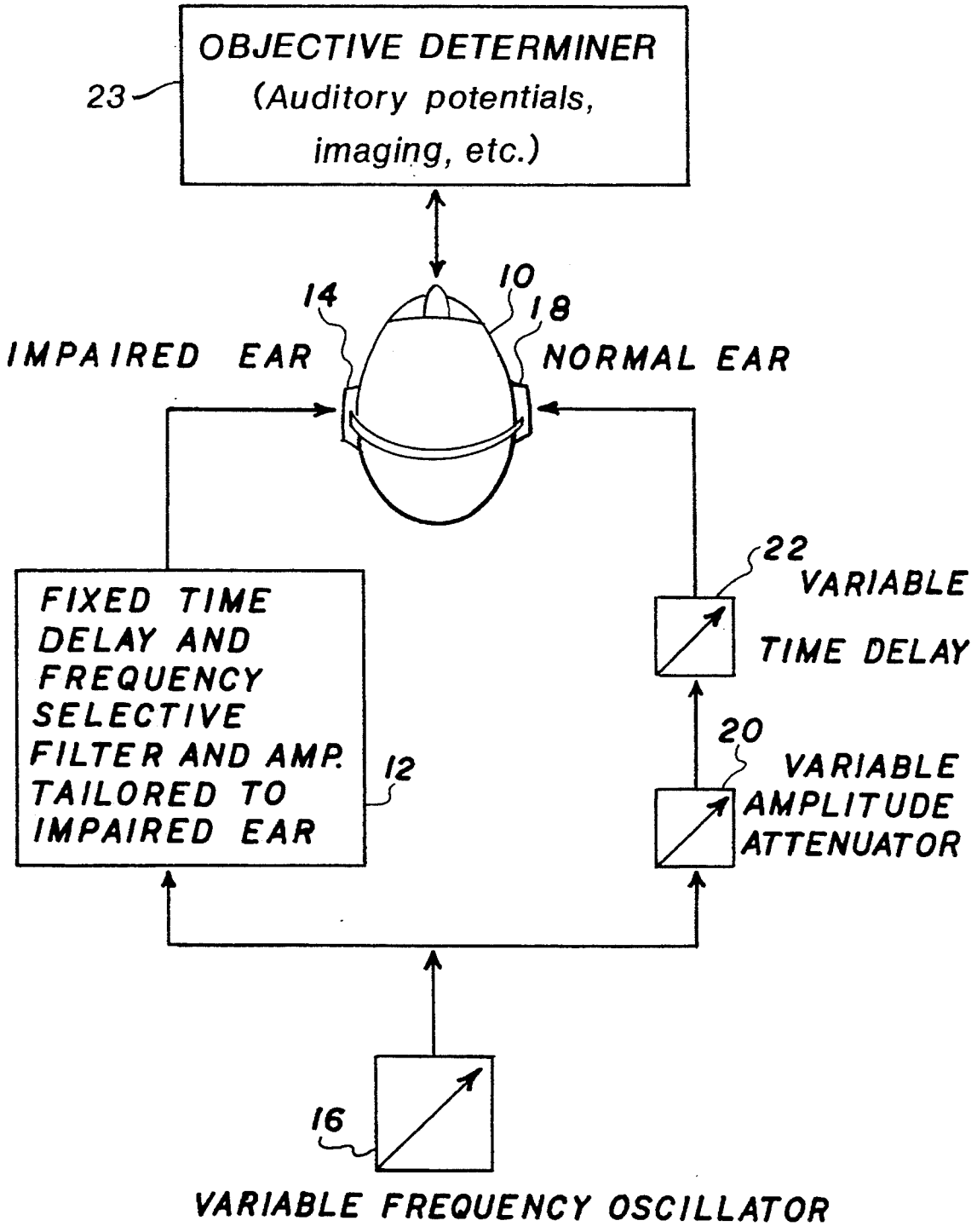

10 patient
12 tailored filter and amplifier
13 tailored filter
14 left earphone
16 variable frequency oscillator
18 right earphone
20 variable amplitude attenuator
22 variable time delay
24 (L & R) microphones
26 (L & R) variable amplifiers
28 fixed time delay
30 frequency filters
32 attenuators
34 time delays
36 (L & R) ear-mounted housing
38 control box
40 vest pocket
42 wiring harness or yoke
44 (L & R) ear speaker tubes
46 outer ear canal
48 microphone sound holes
50 (L & R) speakers
52 (L & R) amplifiers
54 ganged control
56 electronic components block
58 wire harness
60 eyeglass frame
62 (L & R) in-the-ear homing
64 variable gain control
66 adjusting screw
68 FM transmitter
70 transmitter antenna
72 mating FM receiver
74 slave variable gain control
76 passive insert hearing aid
78 through hole
C1–C3 and C1′–C3′ chambers and capacitive equivalents
R1–R3 and R1′–R3′ constricted portions and resistive equivalents

THEORY OF OPERATION

According to the invention, I have discovered that prior-art hearing aids, including the above-described non-linear electronic types, can effect only a relatively low degree of hearing restoration or speech understanding to a patient with asymmetric hearing loss. I have discovered that this limitation of conventional hearing aids is due to the following factors:

I have found that the hearing channels or systems (left and right ears and respective neurological processing channels) of a patient usually are unbalanced or asymetric, i.e., the hearing abilities of such person's two hearing systems are different. This difference, known as an interaural hearing imbalance, occurs in the time delay mode, as well as the amplitude mode.

In the time delay (sometimes loosely called "phase") mode, an interaural difference or shift occurs because the sound processing times of the patient's two hearing channels (i.e., the inner ears and their associated two neurological systems, including hearing perception in the brain) differs. As a result, sounds which arrive at both ears simultaneously, e.g., from a source directly in front of the patient, are processed in different times by the two hearing channels.

This interaural time shift is compounded by the fact that it usually varies with the frequency of the received sound. E.g., the relative delay in one hearing channel may be greater at high frequencies, or at one band of middle frequencies. One result of this is that a patient with a substantially greater delay in the right hearing channel for sounds of a given frequency, say 500 Hz, will perceive that a sound of that frequency from a straight ahead source will appear to come from the the left side, due to an perceived or apparent delay of such sound to reach such patient's right ear. However this apparent source location shift may be so frequency selective as not to be apparent and it is not the main problem, as will be explained.

In addition to the interaural time shift, patients usually also have an interaural amplitude difference. Thus a sound which arrives at the patient's two ears with equal amplitudes will be perceived as being louder in one ear. This difference is also due to differences in the two hearing channels. Again, compounding this problem is the fact that the interaural amplitude difference also usually varies with the frequency of the received sound. E.g., the relative perceived amplitude of sound in one ear may be diminished at one frequency, at high frequencies, or at one band of frequencies (low, middle, or high). As a result, a person with a substantially greater amplitude loss in the right hearing channel for the 500 Hz sound will perceive that a sound of that frequency from a source which is received by both ears with equal amplitudes will appear to be louder in the left ear. However this apparent source location shift may also be so frequency selective as not to be apparent and, again, it is also not the main problem, as will now be explained.

Conventional hearing aids have not been designed to treat or alleviate this lack of balanced hearing perception, especially in the time delay mode. This is because they merely amplify sounds to the weaker ear, and they do this is a relatively primitive manner. I.e., they merely amplify sound fed to the weaker ear, and are not concerned with balancing loudness (perceived sound amplitude) in both ear systems, or with correcting any perceived interaural time shift. As a result, even with a conventional hearing aid, the sound perceived by the patient's two ears is usually either stronger or weaker in the impaired ear, but is seldom balanced in amplitude, much less in perceived arrival time.

I have found that this lack of interaural perceptual balance is a major contributing factor to loss of speech understanding and intelligibility. This is because a patient with unbalanced hearing response (due to either or both perceived interaural time shift and perceived amplitude differences) has relatively low binural processing capabilities, and that good binural processing is necessary to obtain maximum speech perception. In other words, when a person has good interaural balance, this person will process sounds with a high binural capability and physiologically this will enable good hearing and speech perception to occur. On the other hand, when a patient has a relatively poor interaural balance, this person will have a relatively poor binural processing capability, and as a physiological result, this person's hearing and speech perception will be adversely affected. Thus the patient will have relatively poor speech understanding and intelligibility, especially in the presence of general ambient noise, and also will have relatively poor ability to selectively attend.

In other words, a patient with a lack of interaural balance (in perceived arrival time and/or loudness) will have a greatly reduced binural processing capability and as a result will have substantially reduced speech perception. Also I have found that this phenomenon is frequency sensitive, i.e., for each frequency where perceptual hearing isn't balanced, binural processing and hence hearing will be impaired at such frequency.

I have discovered that when a patient's hearing is balanced in perceived arrival time and loudness, across the audible frequency spectrum, his or her ability to binurally process will be greatly increased, and as a result overall hearing will be greatly improved. In fact, a relatively small improvement in balancing will effect a great improvement in binural processing and hence overall hearing ability.

In addition, when a patient has poor interaural balance, such patient's better ear system may actually inhibit the other, poorer ear system to such an extent that the hearing in the poorer ear system is worse than when it functions alone. The correction of this problem at an early stage of a child's development can thus prevent such monaural hearing loss from becoming permanent.

SUMMARY OF INVENTION

In accordance with the invention, a hearing aid employs conventional frequency-selective amplification of the sound to the impaired ear and non-conventional custom-tailored frequency-selective amplitude attenuation and time retardation (delay) of the sound to the better ear so as to increase or restore interaural balancing, in both time and amplitude. I.e., the hearing characteristics of the better ear system are adjusted (reduced in amplitude and matched in perceived time balance across the audible frequency spectrum) so that they match those of the impaired ear, as aided or not, at each frequency in the audible spectrum. Thus the sound perceived by both ears is matched or balanced, at each frequency, in both time and amplitude. This greatly increases the hearer's ability to binurally process sounds and speech. As a result this unique processing system considerably enhances speech perception and understanding.

Although it may seem paradoxical that a delay and/or an amplitude attenuation of sound to one ear will improve speech perception, the result has been empirically verified.

EVALUATION SYSTEM—FIGS. 1A, 1B, AND 1C

FIG. 1A shows a hearing evaluation system for measuring or determining the binural hearing characteristics of a patient 10 so that one can tailor a hearing aid according to the invention for such patient.

Assume that the right ear of patient 10 is a normal or better ear and that the left ear is impaired or weaker. Further assume that patient 10 has already been auditorily tested in a normal manner and that a conventional frequency selective filter and amplifier 12 has been optimally tailored to the impaired ear of patient 10. (Ignore the words "FIXED TIME DELAY AND" in box 12 temporarily.)

E.g., if the hearing perception of patient 10 decreases at higher frequencies (a common condition), the response of filter and amplifier 12 would allow more high frequency signals to pass. Filter and amplifier 12 (sometimes referred to as a receiver), in combination with a microphone (not shown), an amplitude limiting or clipping circuit (not shown), and an ear speaker or earphone 14 constitute a conventional non-linear hearing aid. While such a hearing aid would effect a significant restoration in the hearing ability of patient 10, its capabilities are limited.

As explained supra, I have discovered that this is because such a conventional aid does not take into account any impairment due to perceived interaural time and amplitude differences and hence does not even attempt to balance the hearing perceptions from the two ear system. Specifically, even with the conventional hearing aid, the hearing abilities of patient 10 will still be limited because of interaural perceived time-of-arrival differences at the different audible frequencies. Also, even the boost provided by frequency selective amplifier 12 may not be great enough to bring the hearing of the left ear system up to that of the right ear system, or it may bring the hearing response of left ear system above that of the right ear system, across the audio spectrum or at certain frequencies, so that an interaural perceived amplitude imbalance still remains. As stated, I have found that the perceived interaural time and amplitude differences greatly inhibit the binural processing ability of patient 10 and thus adversely affect hearing, even with amplifier 12.

I have discovered that by taking additional measures, to be described, to match the hearing responses for the two ears, in both time and amplitude, throughout the audible frequency spectrum, a great improvement in binural processing and hence a substantial additional hearing improvement, can be effected. As a result, the hearing (especially speech understanding and intelligibility) of patient 10 can be restored far beyond that obtainable with conventional methods. Specifically, such matching greatly increases the ability of the patient to hear and understand general speech, especially in the presence of general noise, and also to selectively attend, i.e., directionalize the advantages of binural processing that have been restored via balanced perception.

Audio Test, Plot, And Tabulation

In order to provide the additional correction according to the invention, the hearing ability of patient 10 must first be measured. This is done in two frequency sweeps, one for perceived amplitude and one for perceived arrival time, with each sweep involving a frequency scan in discrete steps or ranges.

An audiologist or tester employs an audiometer or variable frequency oscillator (VFO) 16 whose output is connected to amplifier 12 and is set so that after passing through amplifier 12 and earphone 14, the sound (known in the auditory art as a "stimulus") received by the left ear will be at a normal, comfortable listening level. VFO 16 is calibrated in Hertz (cycles per second) from 250 to 8000 Hz (the normal hearing range), in sixteen steps of $\frac{1}{3}$ octave each, as indicated in col. 1 of FIG. 1C. Any other steps or ranges with greater or lesser resolution can alternatively be used. E.g., a simple low, mid, and high range test can be used. The output of VFO 16 also is connected to a right earphone 18 via the series combination of a variable amplitude attenuator (VAA) 20 (calibrated in decibels, abbreviated dB, and representing relative power units) and a variable time delay (VTD) 22 (sometimes known as a variable phase shifter) calibrated in microseconds [mms] of delay). As indicated, amplifier 12 includes a fixed time delay so that VTD 22 in the right ear's channel can be adjusted effectively to advance sound to the right ear, as explained below.

In the first or frequency v. amplitude balancing test, VFO 16 is successively set to each of its sixteen audio frequencies. (A different number of test frequencies, or frequency ranges, can alternatively be used, as is well known to those skilled in audio testing.) VTD 22 is is set to provide zero perceived interaural delay. I.e., it is set so that the tones from VFO 16 appear to come from straight ahead or in the center of the head of patient 10. As VFO 16 is set to each successive frequency, the audiologist or patient adjusts VAA 20 until the sounds in both ear systems appear have equal amplitudes. The setting of VAA 20 is recorded at each frequency. The patient may do both parts of the test with eyes closed to concentrate better.

E.g., FIG. 1B shows, in its bottom two curves, the hearing thresholds of the left and right ear systems of a typical hearing impaired patient fitted with a suitable conventional non-linear hearing aid. The response of a patient with two normal hearing systems is indicated by the horizontal line labeled "Normal". The hearing threshold of the right ear system of this patient is indicated by the plot connecting the small circles and is spaced somewhat down from the normal line, indicating that the response of the right hearing system is somewhat below normal especially at the higher frequencies. The hearing threshold of the left ear system as aided is indicated by the plot connecting the small X's and is spaced somewhat down from the right ear system's plot, indicating that the left hearing system, even as aided, is somewhat farther below normal.

Note that at the lowest frequency, 250 Hz, the left ear system requires 20 dB more sound energy than the right ear to bring this patient's hearing threshold up to normal. Thus when the VAA 20 of FIG. 1A is adjusted to make a balance at 250 Hz, the audiologist or the patient would set the VAA at 20 dB and a resultant "−20" (the hearing deficit) would be the first entry in col. 2 of FIG. 1C.

Alternatively the tabulation of FIG. 1C may be compiled by separately testing each ear system (using a conventional hearing aid with the weaker ear) to form the plot of FIG. 1B. Then the separations between the curves for the two ear systems at each frequency would be measured and tabulated.

After measuring the relative differences in responses of the two ear systems with the apparatus of FIG. 1A, the audiologist will have a tabulation such as that of col. 2 of FIG. 1C. Again, each entry in this column indicates the measured interaural hearing difference in dB of hearing between the impaired or inferior ear system, as aided conventionally, with the normal or superior ear system, for each frequency in col. 1.

For the second sweep the audiologist sets VAA 20 to provide zero attenuation and then tests for interaural time differences in the same manner. Again, VFO 16 is successively set to each of its sixteen audio frequencies, or any other set of frequencies. At each frequency, the audiologist or patient first adjusts VAA 20 to provide equal interaural loudness. Then he or she adjusts VTD 22 until the sound appears to come from the center of the head or straight ahead. Preferably this is done by providing a series of continuous beeps at each selected frequency and providing a dial to control the delay in VTD 22 so that the beeps can be made to come from the left or the right. The patient or the audiologist adjusts ("tunes") the dial until the beeps appear to come from straight ahead or in the center of the patient's head. When this occurs, VTD 22 will have been adjusted to compensate the apparent interaural time difference at that frequency, i.e, the perceived interaural time delay will have been balanced at that frequency. The setting of VTD 22 is recorded at each selected frequency.

The top curve of FIG. 1B plots typical time delay at each frequency as perceived by the left ear versus the right ear. The values of this curve are tabulated in microseconds [rams] of delay in col. 3 of FIG. 1C.

Theoretical Basis

It may be helpful to understand the theory behind these data. While I believe this theory to be valid, I do not wish to be limited thereto as other considerations may be pertinent. As stated, the validity of the invention has been empirically established.

In a person with normal and uniform or matched binural hearing, the time delay in the auditory processing of the sound perceived by both ear systems will be substantially equal at each frequency. Thus, at a given frequency, if a sound source is straight ahead, the person with normal hearing will perceive it as coming from straight ahead since the signals to both ears will both be processed by the ears and their respective associated neurological processing systems in equal times. If the source is to the right of the hearer, the sound signal from the right ear will be perceived as arriving first, and the hearer will process this information, along with relative amplitude information, to recognize it as coming from the right.

This same process similarly occurs at every other frequency for an individual with normal hearing. Thus all sounds from the same source, regardless of frequency, will appear to come from that source, i.e., from a single, sharply-focussed point. As a result the person with normal hearing will have a good binural processing capability and thus can directionalize (selectively attend) to any point and enjoy good speech perception. As a result the normal person will be able to understand speech normally, especially in the presence of noise.

However I have found that most hearing impaired persons have an inherent nonuniformity or unequal auditory delay in the two ear channels, similar to the transmission delay which occurs in some vision-impaired persons, and that this nonuniformity usually varies with frequency, i.e., as indicated in the top curve of FIG 1B. Thus such persons (patients) will have an interaural imbalance, resulting in poor binural processing, in turn resulting in poorer hearing, even with conventional amplification.

In addition I have found that by balancing the interaural time and amplitude differences substantially across the audible frequency range, binural processing is greatly increased and hence hearing perception, especially of speech, is greatly improved.

Alternative Test Procedures

Given the test setup of FIG. 1 and the foregoing theoretical discussion, those skilled in the art will realize that other test procedures may be employed. E.g., different stimulus conditions may be used, such as bilaterally and simultaneously stimulating each ear with different sounds at large and small distances from each ear to determine the best balancing position for that individual. Also stimuli can be applied to the subject's ears in the presence of background noise, such as "cocktail party noise". Further, the tester can do any of the following: rapidly alternate stimuli between the two ears, balance amplitudes at a lower or higher level or a real conversation level, or omit a given frequency or frequencies to both ears and then perceptually balance the responses. The stimuli used can vary, depending upon the individual's various perceptual responses. The tester can thereafter set an appropriate balance.

In addition, "objective", rather than the aforedescribed perceptual balancing, can be employed. Objective balancing can employ electrophysiological means, such as electroencephlograms (EEGs) or measurement of auditory potentials in the brain or auditory nerve to determine a balanced response. Also objective balancing can employ various imaging techniques, such as PET (positron emission tomography), NMR (nuclear magnetic resonance) tomography, etc. to show functional activity in different parts of the brain so as to determine when balance is achieved.

Such objective balancing is most useful for infants or the mentally deficient (who cannot communicate their perceptual responses). If imbalances in infants are corrected, this will prevent permanently imbalanced hearing from occurring during the developmental formative years. I.e., if an imbalance is discovered in an infant, it can be restored by a variety of means (amplitude and/or time balancing, separate stimulation of each ear by occlusion of the other ear, etc.) to force hearing in the impaired ear so that it will develop, rather than being inhibited. The infant and child patient can be monitored on a continuing basis by objective and/or subjective means adapted to his or her age and mental maturity during development, with attendant use of balancing measures. Otherwise the poorer ear's hearing loss will become exaggerated, resulting in the development of a larger and permanent imbalance.

PARADOXICAL HEARING AIR—FIG. 2

Figure 2:
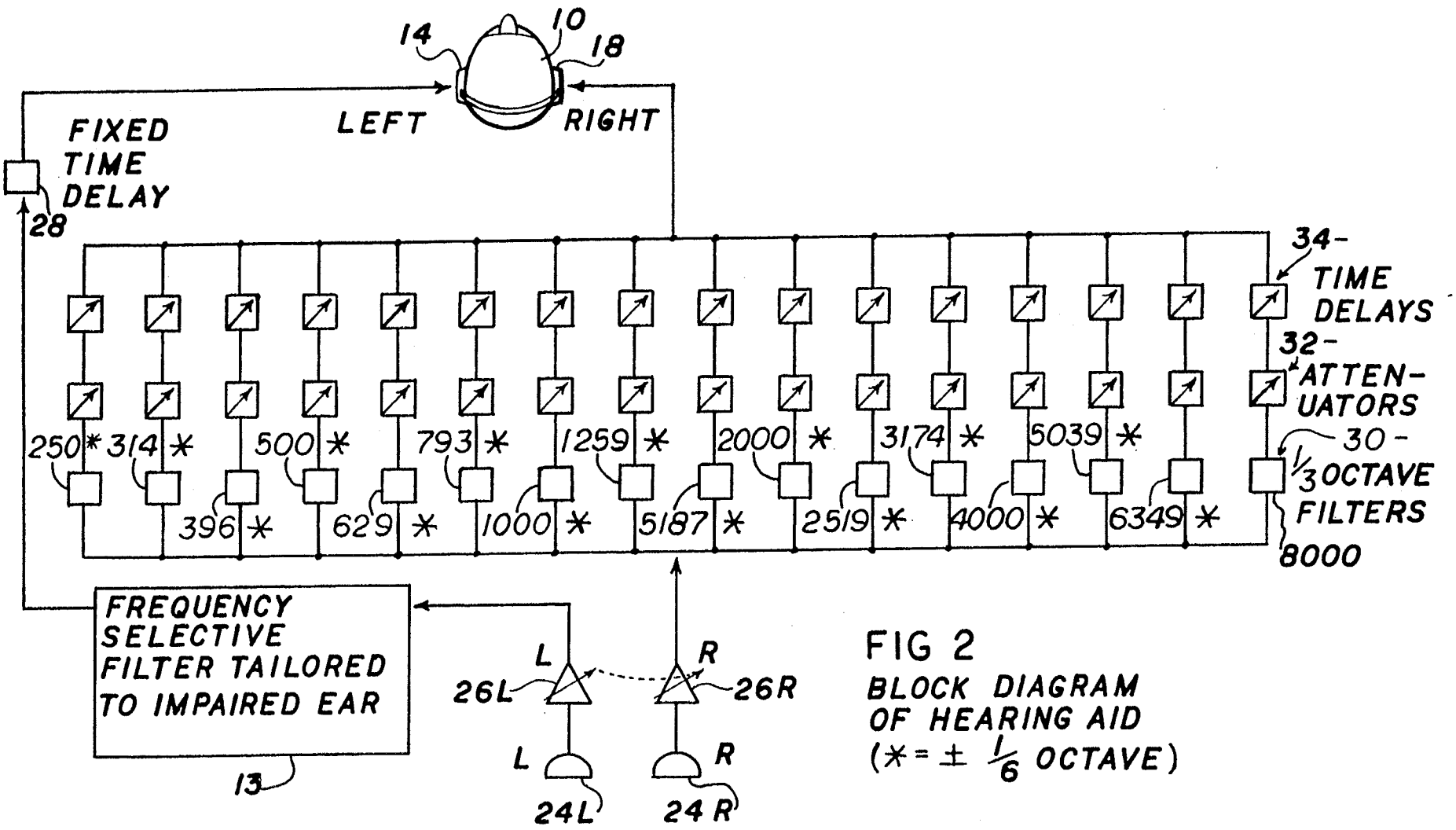
FIG. 2 is an electronic block diagram of a hearing aid according to the invention.

The hearing aid of FIG. 2 employs the above principles in accordance with the invention. This aid will improve the hearing (especially speech perception and understanding) of a hearing-impaired patient, above and beyond that which such patient would obtain with a conventional hearing aid. In fact, the hearing aid of FIG. 2 includes a conventional hearing aid for the poorer ear's system within its components and adds additional components -which increase the patient's total hearing and speech perception. The additional components effectively decrease or balance the hearing system of the better ear to match that of the poorer ear's system, aided or unaided, at each frequency band. As a result the patient's better ear system will match that of the poorer ear system so that sounds from a symmetrically-positioned source will appear to come from straight ahead or from the center of the head i.e., from a location which is symmetrical with respect to the patient's ears, with equal amplitudes and equal perceptual arrival times at each frequency band. I.e., the patient will experience interaural balancing across the audible frequency spectrum. This will in turn greatly increase binural processing and thus overall hearing perception.

The inventive hearing aid of FIG. 2 includes left and right microphones 24L and 24R. The outputs of these microphones are fed to a pair of respective variable-gain amplifiers 26L and 26R, each of which is similar in characteristics to a conventional hearing aid amplifier and preferably has a variable gain of from 0 dB to 65 dB. As indicated by the broken line interconnecting the arrows across these two amplifiers, the gain or volume controls of these are ganged so that their gains can be increased and decreased simultaneously or in tandem. These amplifiers should include conventional limiters (not indicated for purposes of simplification) to prevent damage to the ears in case a very loud sound occurs.

The output of amplifier 24L in the impaired ear's channel is fed to a tailored frequency selective filter 13 similar to that of FIG. 1A, and then, via a fixed time delay 28 of 200 mms (microseconds), to the impaired left ear's earphone 14. Microphone 24L, amplifier 26L, filter 13, and earphone 14 together constitute a conventional non-linear hearing aid, tailored optimally to improve the response of the impaired ear as a function of frequency, as aforedescribed.

In accordance with the invention, the output of amplifier 26R is fed to a series of sixteen (or another selected number of) paralleled filters 30. Each filter is designed to pass $\frac{1}{3}$ octave about its indicated center frequency. The center frequencies of these filters correspond to the sixteen test frequencies used in FIG. 1A, as indicated on the chart of FIG. 1C. Thus the first, 250 Hz, filter 30 will pass 250 Hz$\pm$1/6octave, etc.

The output of each filter 30 is fed to a respective one of sixteen (or another selected number of) variable attenuators 32, each of which can be adjusted to provide from 0 to 50 dB of attenuation. The attenuation values of attenuators 32 are adjusted according to the respective values in the col. 2 of FIG. 1C so as to cause the amplitude response of the better (right) ear to be matched to the aided response of the impaired (left) ear at each frequency. Optionally in lieu of variable attenuators 32, fixed attenuators which are preselected for the necessary values can be used.

Finally the output of each attenuator 32 is fed to a respective one of sixteen (or another selected number of) variable time delays 34, each of which can be adjusted to provide from 0 to 400 mms of time delay. The values of delays 34 are adjusted according to the respective values in col. 3 of FIG. 1C so as to cause the apparent delay response of the better ear to be matched to the perceived response of the impaired ear at each frequency.

Fixed delay 28 (200 mms) in the left, impaired ear's channel is provided to compensate for the delay due to the components in the right or better ear's channel and to enable variable delays 34 to provide the right channel with a relative delay or advance with respect to the left ear. Thus when a delay unit 34 is set to maximum delay (400 mms), sounds in the frequency range controlled by this unit will be delayed about 200 mms with respect to the left ear. When this delay unit is set to provide zero delay, sounds in the frequency range controlled by this unit will effectively be advanced about 200 mms with respect to the left ear.

The outputs of delays 34 are connected to a single lead which is in turn connected to earphone 18 on the right ear.

While the circuit of FIG. 2 has been shown for use with a patient with an impaired left ear and a normal or better right ear, obviously this configuration can be reversed for a patient whose left ear is the better one. The important thing is that, in the case of a patient with a unilateral loss, the perceptual response of the poorer ear be improved conventionally as much as possible and then the response of the better ear be adjusted in apparent arrival time and loudness, at each frequency, to match the curve of the impaired ear as aided. In the case of a bilateral asymetrical loss, both ears should be boosted as much as possible and then the response of the better ear is adjusted, as before. Also, while sixteen frequency bands are used in FIG. 2, obviously fewer or more than sixteen bands can be provided, or even a continuous filtering and delay arrangement which does not use discrete bands can be used. Further, while the components are shown in separate blocks, obviously part of or the entire circuits can be implemented in one or more integrated circuit chips. Also, for optimal restoration, the balancing adjustment may be different for different environments and for different desired sounds, e.g., for street noise, party noise, and large hall noise environments and for listening to traffic sounds, rather than speech. The required balancing adjustments for these cases can be obtained by appropriate hearing tests in the selected environments and with the selected sounds. Thus the hearing aid may have a selector switch (not shown) to adjust its balancing for a number of preselected environments and sounds.

The hearing aid of FIG. 2 has been tested on individuals with impaired hearing and has been found to effect a far greater improvement in hearing than the conventional non-linear aid alone, both in quiet and noisy environments, and with many types of sound sources, especially speech.

The practical implementation of the circuit of FIG. 2 can be performed in a variety of ways, as will now be described.

THREE-PART HEARING AID—FIGS. 3A–3C

Figure 3C:
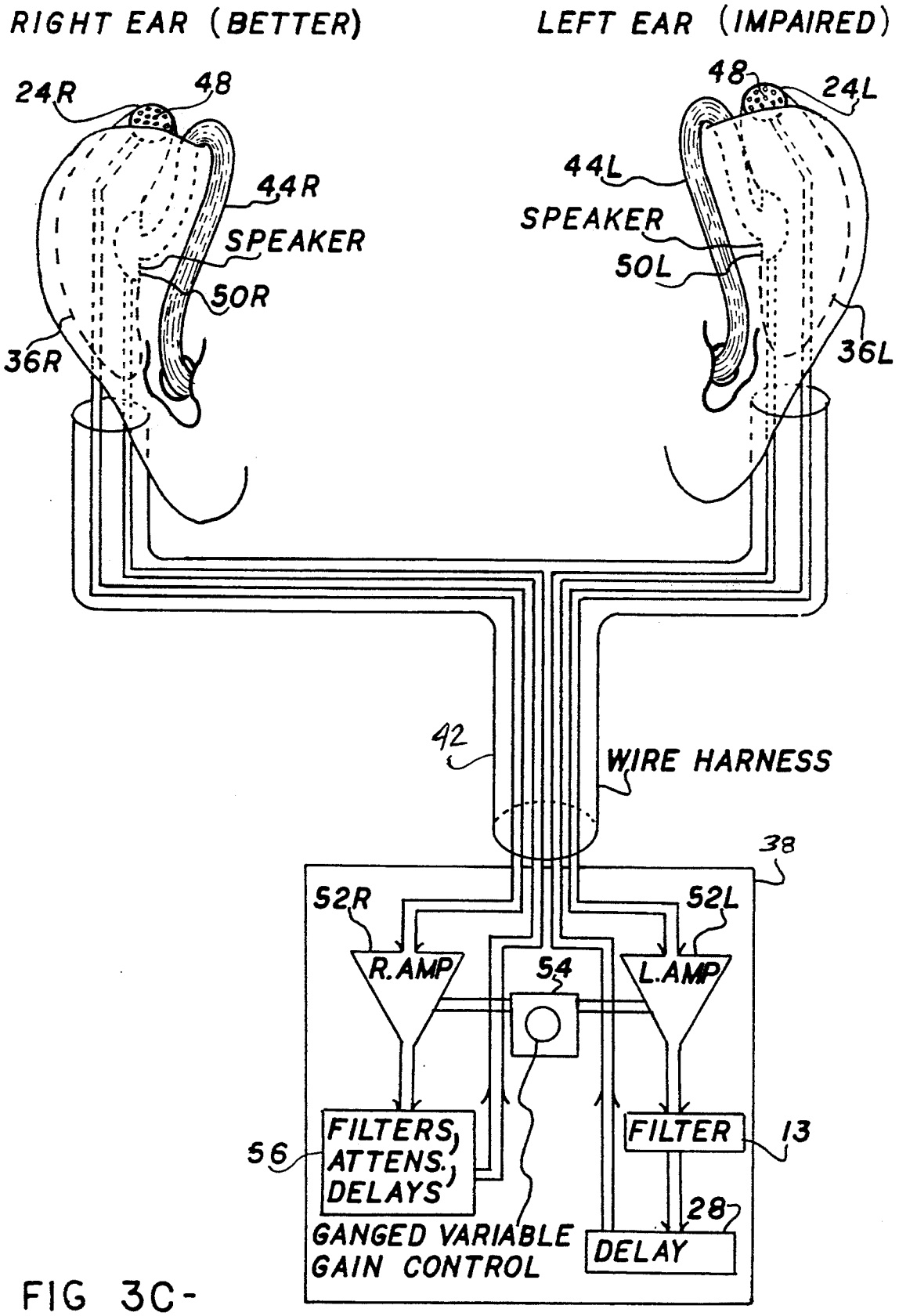
FIG. 3C is a component placement diagram of this hearing aid.

FIGS. 3A to 3C show a diagram of a practical three-part hearing aid according to the invention in use on a patient 10. The aid has a left ear housing 36L which is mounted behind the left ear, a right housing 36R, a control box 38 which is held in a vest pocket 40 of the shirt of patient 10, a wiring harness or yoke 42, and ear speaker tubes 44R and 44L which extend from respective ear housings 36R and 36L into the outer ear canals, such as 46 (FIG. 3B).

Each housing has a curved, elongated shape so that it will fit behind the ear where it is retained by conventional means (not shown). Each housing contains microphone sound holes, such as 48, at its topmost surface, preferably projecting above the ears as indicated to receive high frequency sounds. Each speaker tube 44 extends from a location (not shown) on the rear side of its housing. Wiring harness 42 comprises two pairs of wires extending down from the bottom of each housing to a common junction point and then all eight wires are held together and extend to control box 38.

As shown in FIG. 3C, the ear housings contain respective microphones 24R and 24L, adjacent sound holes 48, and respective speakers 50R and 50L from which extend respective speaker tubes 44R and 44L.

Microphones 24 (R and L) are connected to respective amplifiers 52R and 52L in control box 38. These amplifiers are connected to a common or ganged variable gain or volume control 54 which has a manual control to adjust the volume. The output of left amplifier 52L (for the impaired ear) is connected back to speaker 50L via tailored filter 12 (as in FIG. 2), delay 28 (FIG. 2), and two wires in harness 42. The output of right amplifier 52R is connected to block 56 which contains filters 30, attenuators 32, and delays 34 of FIG. 2, suitably adjusted as previously described. The components in block 56 can be preset, preselected, or can be made to be field adjustable. The output of block 56 is connected back (via harness 42) to speaker 50R for the right or better ear.

Operation of the hearing aid of FIG. 3C is straightforward and in accordance with the principles of the invention previously described in connection with FIG. 2. I.e., sound received by microphone 24L is conventionally amplified and filtered in units 52L and 13, and after compensating delay in unit 28, is fed to speaker 50L, from which it is conducted to the impaired left ear via tube 44L. Sound for the better (right) ear is received by microphone 24R, amplified in amplifier 52R to the same degree of gain as in the left cat's channel. Then the sound (as represented by an electrical signal) is adjusted in accordance with the invention, i.e., it is adjusted in time and amplitude, on a prearranged frequency curve basis, in unit 56 so as to match the characteristics of the aided left ear, such that as great an interaural balance as possible is obtained. Then it is fed to the right ear's speaker and tube 50R and 44R. Amplitude is adjusted conventionally as necessary by means of ganged control 54.

TWO-PART HEARING AID—FIGS. 4A AND 4B

Figure 4A:
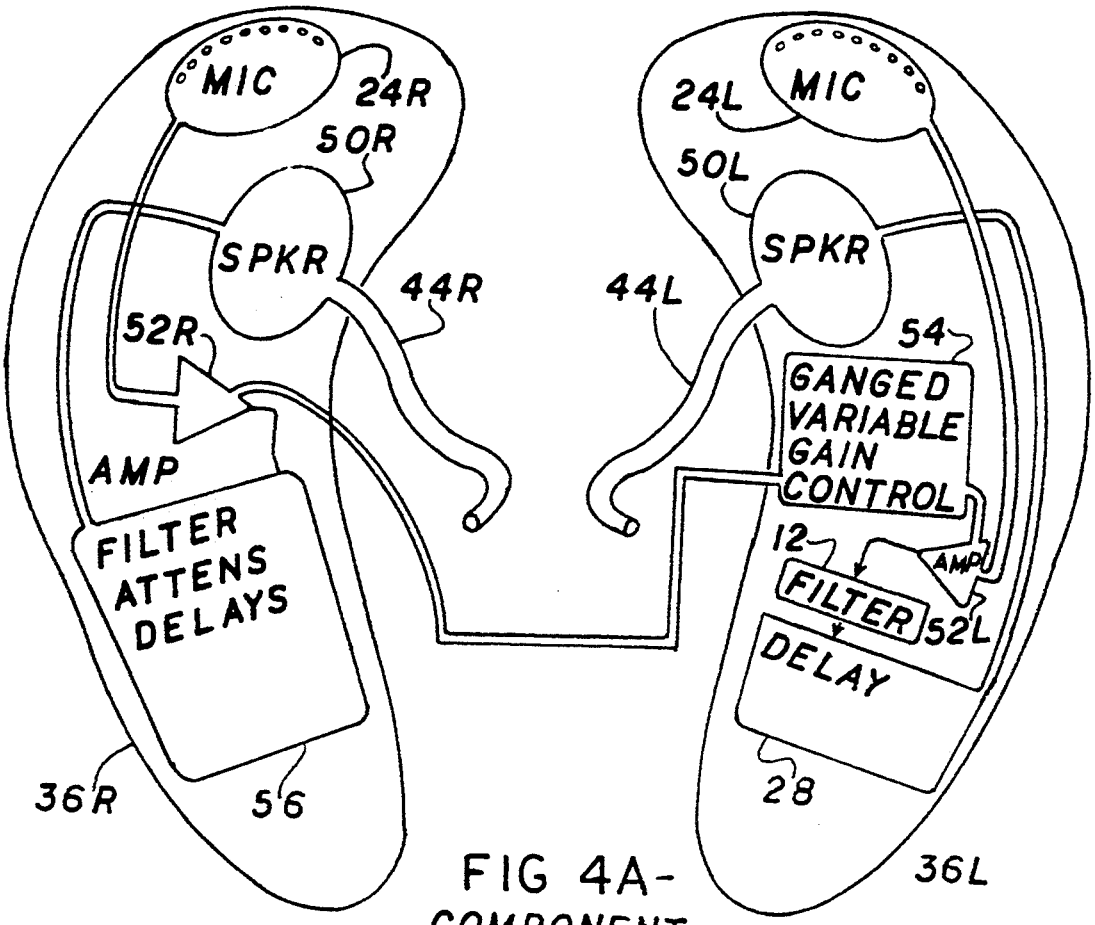
FIG. 4A is a component placement view of a two-part hearing aid according to the invention.
Figure 4B:
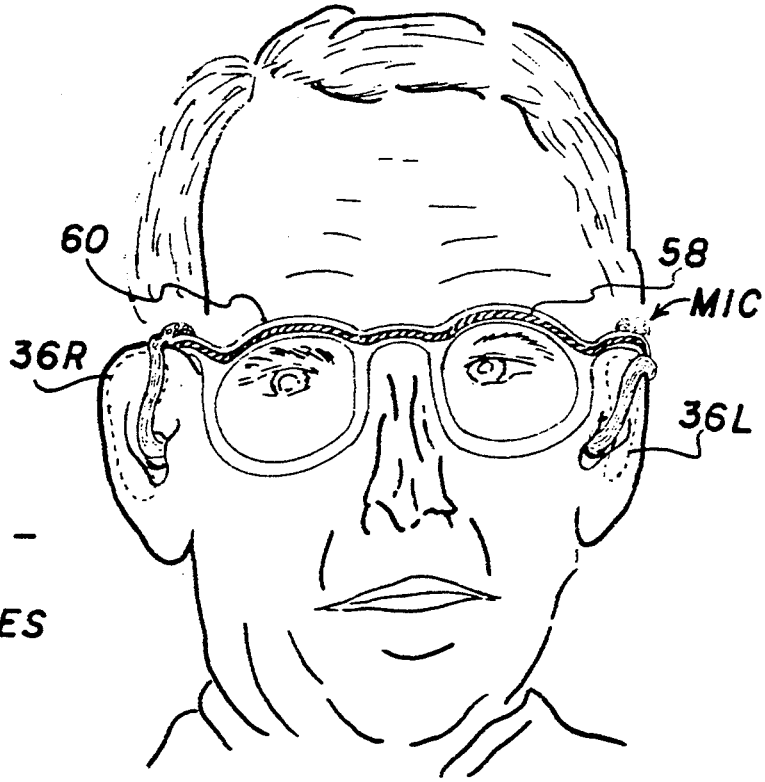
FIG. 4B is view of a pair of eyeglasses employing the hearing aid of FIG. 4A.

In FIG. 4A all of the components of FIG. 2 are provided in a two-part hearing aid wherein all of the components are mounted in two ear housings 36R and 36L, similar to those of FIG. 3A. The two housings are interconnected (for ganging of the volume controls) by a two-lead wire harness 58 which in use would extend behind the head of the patient (not shown in FIG. 4A) or within an eyeglass frame 60 (FIG. 4B). Since the descriptions and the operation of all of the components in FIG. 4A is identical to that of FIG. 3, they will not be detailed again, except to note that ganged volume control 54 is positioned in one of the housings, shown for exemplary purposes as in left housing 36L, and wire harness 5 8 interconnects control 54 to right amplifier 52R outside the housings.

In FIG. 4B two ear housings 36R' and 36L' are mounted at the ends of the temple pieces of eyeglasses 60 in a conventional manner and wires 58' extend through the frame of glasses 60.

As a third alternative, the two-part embodiment could be mounted in a set of earphones (not shown) with all of the components mounted in the earcup housings and the interconnecting wires extending through or on the arch or spring clip which interconnects the earcup housings over the top of the head.

TWO-PART HEARING AID USING RF INTERCONNECTION—FIG. 5

A wireless two-part hearing aid is shown in FIG. 5. All of the components are mounted in two completely separated in-the-ear housings 62R and 62L. All of the components and their operation is similar to that of the preceding embodiments, with two exceptions.

First, the shapes of housings 62R and 62L are designed to fit in and be held in the respective ears. Microphones 24L and 24R are mounted in the outermost side or end of these housings, and speakers 50R and 50L are mounted in the innermost side or end, which would fit inside the ear (not shown) of the patient.

Second, each amplifier has its own variable' gain control. In left ear housing 62L, variable gain control 64 is connected to amplifier 52L and controls the gain thereof. The user operates a miniature potentiometer (not shown) in control 64 by turning a screw 66 with a screwdriver or Allen wrench (not shown). The positional setting of control 64 is also sent to a miniature FM transmitter 68 which has an antenna 70 for continuously transmitting the setting of control 64 by a modulated tone whose frequency is proportional to the level setting of control 64. Transmitter 68 has very low output power since its signal merely needs to reach a mating FM receiver 72 in housing 62R, on the other side of the patient's head, about 20 cm. away. Receiver 72 receives the coded volume control signal from transmitter 68, suitably demodulates it, and adjusts a slave variable gain control 74 which controls the gain of amplifier 52R. Control 74 would employ an electronic control (varistor), well-known in the art, rather than a potentiometer (mechanical gain control element).

Operation of this wireless embodiment is the same as that of the preceding versions, except for the RF gain control ganging. All of the components in each ear housing, except for the microphone and speaker, preferably are formed in a monolithic integrated circuit.

PASSIVE HEARING AID—ACOUSTIC FILTER—FIGS. 6A-6C

A more economical, simpler, lighter, and more compact version of the invention is provided in the form of a passive hearing aid, as shown in FIGS. 6A to 6B. This device comprises a mechanical insert 76 which is made of densely-packed, but compliant foam rubber, urethane, or any other flexible, body-compatible material which can be compressed and inserted into the ear where it expands to hold itself firmly in place and seal the outer ear canal.

Insert 76 has a cylindrical shape with a through hole 78 extending axially therethrough. The inside of inset 76 comprises a series of chambers, three of which, C1 to C3, are shown (FIG. 6B) for exemplary purposes. Adjacent chambers are interconnected and the end chambers are connected to the ends of the insert by a plurality of tubes R1–R4 which are part of hole 78. The body of insert 76, save for chambers C1 to C3, is a "solid" body of foam. Preferably insert 76 is 10 to 15 mm long and 6 mm in diameter. Hole 78 may be about 1 mm in diameter and chambers C1 to C3 may each be about 5 mm in diameter by 3 mm long axially.

An electrical equivalent circuit to the insert is shown in FIG. 6C; it comprises four-terminal network having a plurality of series resistors R1' to R4' and a plurality of shunt capacitors C1' to C3' respectively connected to the junctions of adjacent resistors. Resistors R1' to R4 ∝ correspond respectively to the tubes or the constricted portions in FIG. 6B and capacitors C1' to C3' correspond respectively to chambers C1 to C3 of FIG. 6B.

When insert 76 is placed in the ear, its chambers and constricted portions will have the same effect on received sound as the equivalent circuit of FIG. 6C will to an alternating electrical signal. The chambers and constricted portions will delay and attenuate an applied signal in a frequency-selective manner just as the equivalent circuit will to an electrical signal so that higher-frequency sounds will be delayed and attenuated more.

In use, the patient wears a conventional hearing aid in the impaired ear and insert 76 in the better ear. The characteristics of insert 76 can be tailored by altering the size of the chambers and interconnecting tubes to cause hearing in the better ear more nearly to match that of the impaired ear. The insert will attenuate and delay sounds received in the better ear so as to make its perception closer to that of the impaired ear, as aided.

Alternatively, the insert can be used in the better ear even without aiding the impaired ear and it will still improve interaural balance, thereby improving binural perception and thus overall hearing.

SUMMARY, RAMIFICATIONS, AND SCOPE

Accordingly the reader will see that, according to the invention, I have provided a seemingly paradoxical hearing aid which can improve hearing to a greater extent than possible with heretofore available technology, including non-linear tailored hearing aids. This improvement is effected by adjusting the sound from the better ear so that its speech and/or sound perception more nearly matches that of the impaired ear, thereby to improve interaural balance, which will in turn improve the aided patient's binural processing mechanism and thus physiologically effect improved hearing, especially general speech perception, speech in the presence of noise, and the ability of the patient to selectively attend.

While the above description contains many specificities, these should not be construed as limitations on the scope of the invention, but as exemplifications of the presently-preferred embodiments thereof. Many other ramifications and variations are possible within the teachings of the invention.

For example, a hearing aid can be provided which merely delays sound arriving at the better ear so as to match the perceived arrival times of the sound to both ears, which I have found will by itself effect a significant improvement. Such a time delay can be provided by either a passive or an electronic aid. Also a hearing aid can be provided which merely attenuates sound arriving at the better ear, either linearly or with frequency selective attenuation, so as to match the amplitudes of the sounds to both ears. The term "adjusting" as used in the claims includes decreasing or increasing amplitude of sound and/or retarding or advancing the time of arrival of sound. Advancing the arrival time of sound to one ear can be effectively accomplished by delaying sound to the other ear and providing a lesser delay to sound at the one ear. The ganging of the volume controls for the two channels can be eliminated, whereupon the user would effect a balance by adjusting the two controls. Many other practical configurations of the three- and two-part embodiments will be envisioned, and the circuitry within the parts can take other configurations, including a digital microprocessor controlled by a PROM, a dedicated microprocessor, discrete circuitry, etc.

Thus the scope of the invention should be determined by the appended claims and their legal equivalents, and not by the examples given.

I claim:

1. A method for improving binaural hearing balance of a person with two functioning ear systems, one of which has hearing perception which is poorer than hearing perception in said person's other and better ear system, said method comprising:

(a) determining differences in binaurally perceived intensities and in binaurally perceived sound arrival times between such person's left and right ear systems so as to determine a difference in hearing perception between said person's two ear systems, and (b) adjusting (1) intensity of sound to at least one of said person's ear systems, and (2) arrival time of sound to at least one of said person's ear systems in accordance with said determined differences in binaurally perceived intensities and binaurally perceived sound arrival times between such person's two ear systems such as to decrease said differences and achieve better interaural balance between said person's two ear systems, thereby to improve interaural perceptual balance between said person's two ear systems and binaural processing of said person, and thus improve said person's hearing, including speech perception, for different environments and different sound levels.

2. The method of claim 1 wherein said adjusting is done as a function of frequency.

3. The method of claim 1 wherein said adjusting is done to said person's poorer ear system.

4. The method of claim 1 wherein said adjusting is performed by passive means.

5. The method of claim 1 wherein:

(a) said determining differences is done with objective means for indicating when improved hearing balance is achieved between said person's two ear systems by determining functional activity in said person's nervous system, said objective means comprising an external instrument, (b) said objective means is used to determine, in said person's nervous system, optimal functional activity which indicates improved hearing balance, whereby said determining can be done with infants and adults, or mentally impaired patients and other patients who cannot sufficiently communicate their perceptual responses, so that said determination of optimal functional activity can be used to provide a hearing aid which improves binaural balance.

6. The method of claim 1 wherein said adjusting is further done so that when said person hears a single sound source which emits sounds at a plurality of different frequencies, said person will perceive said sounds at said plurality of different frequencies as all appearing to come from substantially one location in space.

7. A binaural hearing aid for improving binaural hearing balance in a person with two functioning ear systems, one of which has hearing perception which is poorer than the hearing perception in said person's other and better ear system, said binaural hearing aid comprising:

(a) sound-receiving means for receiving sound to at least one of said person's ear systems, and (b) sound-adjusting means for adjusting (1) intensity of received sound to at least one of said person's two ear systems, and (2) arrival time of received sound to at least one of said person's two ear systems, (c) said sound-adjusting means being arranged to decrease perceived interaural differences in arrival times and intensities of said received sound between said person's two ear systems and achieve improved interaural hearing balance in perceived arrival times and intensities between said person's two ear systems, thereby to improve binaural processing of said person and thus improve said person's hearing, including speech perception, for different environments and different sound levels.

8. The hearing aid of claim 7 wherein said sound-adjusting means adjusts said intensity and said arrival time as a function of frequency.

9. The hearing aid of claim 7, further including additional sound-adjusting means for adjusting sound to said person's poorer ear system.

10. The hearing aid of claim 7 wherein said sound-adjusting means comprises means for separating received sound into a plurality of separate frequency bands, and means for selectively adjusting perceived arrival times and perceived intensities of said sound in said separate frequency bands.

11. The hearing aid of claim 10 wherein said sound-receiving means comprises a microphone, said means for separating received sound into separate frequency bands comprises a plurality of filters, and said means for selectively adjusting perceived arrival times and intensifies of sound in said separate frequency bands comprises a plurality of attenuators and delays.

12. The hearing aid of claim 7, further including a pair of ear housings, said sound-receiving means and said sound-adjusting being mounted within said pair of ear housings, and further including coupling means for coupling signals from within one of said housings to within the other of said housings, said means for coupling signals comprising a wireless link.

13. The hearing aid of claim 7, further including:

(a) objective means for indicating when improved hearing balance is achieved between said person's two ear systems by determining functional activity in said person's nervous system, (b) said objective means comprising an external instrument, (c) said objective means being usable with said sound-adjusting means for determining, in said person's nervous system, optimal functional activity which indicates improved hearing balance, whereby said objective means can be used with infants and adults, or mentally impaired patients and other patients who cannot sufficiently communicate their perceptual responses, so that said determination of optimal functional activity can be used to provide a hearing aid which improves binaural balance.

14. A method for improving binaural hearing balance of a person with two functioning ear systems, one of which has hearing perception which is poorer than hearing perception in said person's other and better ear system, said method comprising:

(a) adjusting arrival time of sound to at least one of said person's ear systems by an amount less than one millisecond, and (b) adjusting intensity of sound to at least one of said person's ear systems, (c) said adjusting of said arrival time and said intensity being arranged to decrease perceived interaural differences in arrival times and intensities between said person's two ear systems and achieve improved interaural hearing balance in perceived arrival times and intensities between said person's two ear systems, thereby to improve interaural perceptual balance between said person's two ear systems and binaural processing of said person, and thus improve said person's hearing, including speech perception, for different environments and different sound levels.

15. The method of claim 14 wherein said adjusting is done as a function of frequency.

16. The method of claim 14, further including:

(a) providing objective means for indicating when improved hearing balance is achieved between said person's two ear systems by determining functional activity in said person's nervous system, said objective means comprising an external instrument, and (b) using said objective means while said sound is being adjusted to determine, in said person's nervous system, optimal functional activity which indicates improved hearing balance, whereby said determining can be done with infants and adults, or mentally impaired patients and other patients who cannot sufficiently communicate their perceptual responses, so that said determination of optimal functional activity can be used to provide a hearing aid which improves binaural balance.

17. The method of claim 14 wherein said adjusting is further done so that when said person hears a single sound source which emits sounds at a plurality of different frequencies, said person will perceive said sounds at said plurality of different frequencies as all appearing to come from substantially one location in space.

18. A method for improving binaural hearing balance in a person with two functioning ear systems, one of which has hearing perception which is poorer than hearing perception in said person's other and better ear system, said method comprising:

(a) receiving sound to at least one of said person's ear systems, and (b) adjusting arrival time of received sound to said one of said person's ear systems by less than one millisecond, (c) said adjusting of said arrival time of said received sound being arranged to decrease perceived interaural differences in arrival times of said received sound between said person's two ear systems and achieve improved interaural hearing balance in perceived arrival times between said person's two ear systems, thereby to improve binaural processing of said person, and thus improve said person's hearing, including speech perception, for different environments and different sound levels.

19. The method of claim 18 wherein said adjusting is done as a function of frequency.

20. The method of claim 18, further including:

(a) providing objective means for indicating when improved hearing balance is achieved between said person's two ear systems by determining functional activity in said person's nervous system, said objective means comprising an external instrument, and (b) using said objective means while said sound is being adjusted to determine, in said person's nervous system, optimal functional activity which indicates improved hearing balance, whereby said determining can be done with infants and adults, or mentally impaired patients and other patients who cannot sufficiently communicate their perceptual responses, so that said determination of optimal functional activity can be used to provide a hearing aid which improves binaural balance.

21. The method of claim 18 wherein said adjusting is further done so that when said person hears a single sound source which emits sounds at a plurality of different frequencies, said person will perceive said sounds at said plurality of different frequencies as all appearing to come from substantially one location in space.

22. A method for improving binaural hearing balance of a person with two functioning ear systems, one of which has hearing perception which is poorer than hearing perception in said person's other and better ear system, said method comprising:

(a) receiving sound to at least one of said person's ear systems, and (b) adjusting intensity of received sound as a function of frequency to said one of said person's ear systems, (c) said adjusting intensity of received sound being done so that when sound at a plurality of different frequencies emanating from a single source reaches said person's two ear systems, said person will have a decrease in perceived interaural difference in intensities of said received sound between said person's two ear systems and achieve improved interaural hearing balance in perceived intensities between said person's two ear systems, thereby to achieve simultaneous, interactive binaural processing at said plurality of different frequencies, with said person's two ear systems being centrally coordinated, and thereby to improve interaural perceptual balance and binaural processing of said person, and thus improve said person's hearing, including speech perception, for different environments and different sound levels.

23. The method of claim 22, further including:

(a) providing objective means for indicating when improved heating balance is achieved between said person's two ear systems by determining functional activity in said person's nervous system, said objective means comprising an external instrument, and (b) using said objective means while said sound is being adjusted to determine, in said person's nervous system optimal functional activity which indicates improved hearing balance, whereby said determining can be done with infants and adults, or mentally impaired patients and other patients who cannot sufficiently communicate their perceptual responses, so that said determination of optimal functional activity can be used to provide a hearing aid which improves binaural balance.

24. The method of claim 22 wherein said adjusting is further done so that when said person hears a single sound source which emits sounds at a plurality of different frequencies, said person will perceive said sounds at said plurality of different frequencies as all appearing to come from substantially one location in space.

25. A method for improving binaural hearing balance of a person with two functioning ear systems, one of which has hearing perception which is poorer than hearing perception in said person's other and better ear system, comprising:

(a) receiving sound to at least one of said person's ear systems, and (b) adjusting (1) intensity of received sound to said one of said person's ear systems, and (2) arrival time of received sound to said one of said person's ear systems, (c) said adjusting of said intensity and arrival time of said received sound being arranged to decrease perceived interaural differences in intensities and arrival times between said person's two ear systems and achieve improved interaural hearing balance in perceived intensities and arrival times of said received sound between said person's two ear systems, and such as to cause perceived interaural intensities and perceived arrival times of sound in said person's two ear systems to be closer together, thereby to improve interaural perceptual balance and binaural processing of said person, and thus improve said person's hearing, including speech perception, for different environments and different sound levels.

26. The method of claim 25, further including a step of determining differences in perceived intensities and perceived sound arrival times of sound between said person's left and right ear systems so as to determine a difference in hearing between said person's two ear systems, and wherein said adjusting is done so as to reduce said differences between said person's left and right ear systems.

27. The method of claim 26 wherein:

(a) said determining differences is done with objective means for indicating when improved hearing balance is achieved between said person's two ear systems by determining functional activity in said person's nervous system, said objective means comprising an external instrument, (b) said objective means is used to determine, in said person's nervous system, optimal functional activity which indicates improved hearing balance, whereby said determining can be done with infants and adults, or mentally impaired patients and other patients who cannot sufficiently communicate their perceptual responses, so that said determination of optimal functional activity can be used to provide a hearing aid which improves binaural balance.

28. The method of claim 27 wherein said adjusting is performed as a function of frequency.

29. The method of claim 27 wherein said adjusting is further done so that when said person hears a single sound source which emits sounds at a plurality of different frequencies, said person will perceive said sounds at said plurality of different frequencies as all appearing to come from substantially one location in space.

30. A binaural hearing aid for improving binaural hearing balance in a person with two functioning ear systems, one of which has hearing perception which is poorer than hearing perception in said person's other and better ear system, said binaural hearing aid comprising:

(a) sound-receiving means for receiving sound to at least one of said person's ear systems, and (b) sound-adjusting means for adjusting (1) intensity of received sound said one of said person's two ear systems so as to bring perceived intensities of said received sound to said person's two ear systems closer together, and (2) arrival time of said received sound to said one of said person's two ear systems so as to bring perceived arrival times of received sound to said person's two ear systems closer together, thereby to improve interaural perceptual balance between said person's two ear systems and binaural processing of said person, and thus improve said person's hearing, including speech perception, for different environments and different sound levels.

31. The hearing aid of claim 30 wherein said means for adjusting adjusts said intensity and said arrival time as a function of frequency.

32. The method of claim 30 wherein said adjusting is further done so that when said person hears a single sound source which emits sounds at a plurality of different frequencies, said person will perceive said sounds at said plurality of different frequencies as all appearing to come from substantially one location in space.

33. The hearing aid of claim 30, further including:

(a) objective means for indicating when improved hearing balance is achieved between said person's two ear systems by determining functional activity in said person's nervous system, (b) said objective means comprising an external instrument, (c) said objective means being usable with said sound-adjusting means for determining, in said person's nervous system, optimal functional activity which indicates improved hearing balance, whereby said objective means can be used with infants and adults, or mentally impaired patients and other patients who cannot sufficiently communicate their perceptual responses, so that said determination of optimal functional activity can be used to provide a heating aid which improves binaural balance.

34. A method for improving binaural hearing balance of a person with two functioning ear systems, one of which has hearing perception which is poorer than hearing perception in said person's other and better ear system, said method comprising:

(a) receiving sound to at least one of said person's ear systems, and (b) adjusting arrival time of sound to said one of said person's ear systems, (c) said adjusting arrival time of sound being less than one millisecond, (d) said adjusting arrival time of sound also being selected so as to cause said person to perceive sounds within said person's ear systems as coming from a more symmetrical location with respect to said person than without said adjustment, thereby to improve interaural perceptual balance between said person's two ear systems and binaural processing of said person, and thus improve said person's hearing, including speech perception, for different environments and different sound levels.

35. The method of claim 34, further including:

(a) providing objective means for indicating when improved hearing balance is achieved between said person's two ear systems by determining functional activity in said person's nervous system, said objective means comprising an external instrument, and (b) using said objective means while said sound is being adjusted to determine, in said person's nervous system, optimal functional activity which indicates improved hearing balance, whereby said determining can be done with infants and adults, or mentally impaired patients and other patients who cannot sufficiently communicate their perceptual responses, so that said determination of optimal functional activity can be used to provide a hearing aid which improves binaural balance.

36. A method for improving binaural hearing balance in a person with two functioning ear systems, one of which has hearing perception which is poorer than hearing perception in said person's other and better ear system, said method comprising:

(a) receiving sound to at least one of said person's ear systems, and (b) adjusting intensity of received sound to said one of said person's ear systems at a plurality of different frequencies in a manner so that when said person hears a single sound source which emits sounds at a plurality of different frequencies, said person will perceive said received sounds at said plurality of different frequencies as all appearing to come from substantially one location in space and said person will experience simultaneous, interactive, binaural processing at said plurality of different frequencies, with said person's two ear systems being centrally coordinated, thereby to improve said person's interaural perceptual balance and binaural processing, and thus improve said person's hearing, including speech perception, for different environments and different sound levels.

37. The method of claim 36, further including:

(a) providing objective means for indicating when improved hearing balance is achieved between said person's two ear systems by determining functional activity in said person's nervous system, said objective means comprising an external instrument, and (b) using said objective means while said sound is being adjusted to determine optimal functional activity in said person's nervous system which indicates improved hearing balance, whereby said determining can be done with infants and adults, or mentally impaired patients and other patients who cannot sufficiently communicate their perceptual responses, so that said determination of optimal functional activity can be used to provide a hearing aid which improves binaural balance.

38. A binaural hearing aid for improving binaural hearing balance in a person with two functioning ear systems, one of which has hearing perception which is poorer than the hearing perception in said person's other and better ear system, said binaural hearing aid comprising:

(a) sound-receiving means for receiving sound to at least one of said person's ear systems, and (b) sound-adjusting means for adjusting (1) intensity of received sound to at least one of said person's two ear systems as a function of frequency, and (2) arrival time of received sound to at least one of said person's two ear systems as a function of frequency, so that when said person hears a single sound source which emits sounds at a plurality of different frequencies, said person will perceive received sounds at said plurality of different frequencies as all appearing to come from substantially one location in space, thereby to improve interaural perceptual balance between said person's two ear systems and binaural processing of said person, and thus improve said person's hearing, including speech perception, for different environments and different sound levels.

39. The method of claim 38, further including:

(a) objective means for indicating when improved hearing balance is achieved between said person's two ear systems by determining functional activity in said person's nervous system, (b) said objective means comprising an external instrument, (c) said objective means being usable with said sound-adjusting means for determining, in said person's nervous system, optimal functional activity which indicates improved hearing balance, whereby said objective means can be used with infants and adults, or mentally impaired patients and other patients who cannot sufficiently communicate their perceptual responses, so that said determination of optimal functional activity can be used to provide a hearing aid which improves binaural balance.

40. A binaural hearing aid for improving binaural hearing balance in a person with two functioning ear systems, one of which has hearing perception which is poorer than the hearing perception in said person's other and better ear system, said binaural hearing aid comprising:

(a) sound-receiving means for receiving sound to at least one of said person's ear systems, and (b) sound-adjusting means for adjusting arrival time of received sound to said one of said person's two ear systems as a function of frequency such that when said person hears a single sound source which emits sounds at a plurality of different frequencies, said person will perceive said sounds at said plurality of different frequencies as all appearing to come from substantially one location in space, thereby to improve interaural perceptual balance between said person's two ear systems and binaural processing of said person, and thus improve said person's hearing, including speech perception, for different environments and different sound levels.

41. The hearing aid of claim 40, further including:

(a) objective means for indicating when improved hearing balance is achieved between said person's two ear systems by determining functional activity in said person's nervous system, (b) said objective means comprising an external instrument, (c) said objective means being usable with said sound-adjusting means for determining, in said person's nervous system, optimal functional activity which indicates improved hearing balance, whereby said objective means can be used with infants and adults, or mentally impaired patients and other patients who cannot sufficiently communicate their perceptual responses, so that said determination of optimal functional activity can be used to provide a hearing aid which improves binaural balance.

42. A binaural hearing aid for improving binaural hearing balance in a person with two functioning ear systems, one of which has hearing perception which is poorer than the hearing perception in said person's other and better ear system, said binaural hearing aid comprising:

(a) sound-receiving means for receiving sound to at least one of said person's ear systems, and (b) sound-adjusting means for adjusting (1) intensity of received sound at a plurality of frequencies to said one ear system, and (2) arrival time of received sound at a plurality of frequencies to said one ear system such as to decrease said person's perceived interaural differences and improve said person's binaural processing and said person's hearing, including speech perception, for different environments and different sound levels at said plurality of frequencies.

43. The hearing aid of claim 42, further including:

(a) objective means for indicating when improved hearing balance is achieved between said person's two ear systems by determining functional activity in said person's nervous system, (b) said objective means comprising an external instrument, (c) said objective means being usable with said sound-adjusting means for determining, in said person's nervous system, optimal functional activity which indicates improved hearing balance, whereby said objective means can be used with infants and adults, or mentally impaired patients and other patients who cannot sufficiently communicate their perceptual responses, so that said determination of optimal functional activity can be used to provide a hearing aid which improves binaural balance.

44. A method for improving binaural hearing balance of a person with two functioning ear systems, one of which has hearing perception which is poorer than hearing perception in said person's other and better ear system, said method comprising:

(a) receiving sound to at least one of said person's ear systems, and (b) adjusting arrival time of sound to said one of said person's ear systems at a plurality of different frequencies so as to decrease perceived interaural differences in arrival times between said person's two ear systems and achieve improved interaural hearing balance in perceived arrival times between said person's two ear systems, thereby to improve interaural perceptual balance between said person's two ear systems and binaural processing of said person, and thus improve said person's hearing, including speech perception, for different environments and different sound levels.

45. The method of claim 44, further including:

(a) providing objective means for indicating when improved hearing balance is achieved between said person's two ear systems by determining functional activity in said person's nervous system, said objective means comprising an external instrument, and (b) using said objective means while said sound is being adjusted to determine, in said person's nervous system, optimal functional activity which indicates improved hearing balance, whereby said determining can be done with infants and adults, or mentally impaired patients and other patients who cannot sufficiently communicate their perceptual responses, so that said determination of optimal functional activity can be used to provide a hearing aid which improves binaural balance.

46. A method for improving binaural hearing balance of a person with two functioning ear systems, one of which has hearing perception which is poorer than hearing perception in said person's other and better ear system, said method comprising:

(a) receiving sound to at least one of said person's ear systems, (b) providing objective means for indicating when improved hearing balance is achieved between said person's two ear systems by determining functional activity in said person's nervous system, said objective means comprising an external instrument, (c) adjusting intensity of received sound to said one of said one of said person's ear systems at a plurality of different frequencies, (d) said intensity adjustment being done while using said objective means to determine optimal functional activity in said person's nervous system which indicates improved hearing balance, whereby said adjusting can be done with infants and adults, or mentally impaired patients and other patients who cannot sufficiently communicate their perceptual responses, so that said determination of optimal functional activity can be used to provide a hearing aid which improves binaural balance and so that said person's hearing, including speech perception, will be improved for different environments and different sound levels.

47. A method for improving binaural hearing balance of a person with two functioning ear systems, one of which has hearing perception which is poorer than hearing perception in said person's other and better ear system, said method comprising:

(a) receiving sound to at least one of said person's ear systems, and (b) adjusting (1) arrival time of sound to said one of said person's ear systems at a plurality of frequencies, and (2) intensity of sound to said one of said person's ear systems at said plurality of frequencies, (c) said adjusting being such that when said person hears a single sound source which emits sounds at a plurality of different frequencies, said person will perceive said sounds at said plurality of different frequencies as all appearing to come from substantially one location in space, thereby to improve interaural perceptual balance between said person's two ear systems and binaural processing of said person, and thus improve said person's hearing, including speech perception, for different environments and different sound levels.

48. The method of claim 47, further including:

(a) providing objective means for indicating when improved hearing balance is achieved between said person's two ear systems by determining functional activity in said person's nervous system, said objective means comprising an external instrument, and (b) using said objective means while said sound is being adjusted to determine optimal functional activity in said person's nervous system which indicates improved hearing balance, whereby said determining can be done with infants and adults, or mentally impaired patients and other patients who cannot sufficiently communicate their perceptual responses, so that said determination of optimal functional activity can be used to provide a hearing aid which improves binaural balance.

49. A method for determining conditions for achieving improved binaural balance in hearing between a person's ear systems, wherein said person has two functioning ear systems, one of which has hearing perception which is poorer than hearing perception in said person's other and better ear system, said method comprising:

(a) providing objective means for indicating when improved hearing balance is achieved between said person's two ear systems by determining functional activity in said person's nervous system, said objective means comprising an external instrument, (b) adjusting sound to at least one of said person's ear systems, and (c) using said objective means while said sound is being adjusted to determine optimal functional activity in said person's nervous system which indicates improved hearing balance, whereby said determining can be done with infants and adults, or mentally impaired patients and other patients who cannot sufficiently communicate their perceptual responses, so that said determination of optimal functional activity can be used to provide a hearing aid which improves binaural balance.

50. The method of claim 49 wherein said adjusting sound is used to adjust arrival time of sound.

51. The method of claim 49 wherein said adjusting sound is used to adjust intensity of sound.

52. The method of claim 49 wherein said adjusting sound is used to adjust arrival time and intensity of sound.

53. The method of claim 49 wherein said adjusting sound is done as a function of frequency of said sound.

54. The method of claim 49 wherein said adjusting sound is used to adjust intensity of sound as a function of frequency of said sound.

* * * * *

UNITED STATES PATENT AND TRADEMARK OFFICE

CERTIFICATE OF CORRECTION

PATENT NO. : 5,434,924

DATED : July 18, 1995

INVENTOR(S) : Arthur Jampolsky

It is certified that error appears in the above-indentified patent and that said Letters Patent is hereby corrected as shown below:

Col. 9, l. 36, change "AIR" to read -- AID --

Col. 9, l. 46, delete "-".

Col. 13, l. 49, delete "α" to read -- R4' --

Signed and Sealed this

Fourteenth Day of November, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO.: 5,434,924

DATED: Jul. 18, 1995

PATENTEE: Arthur Jampolsky

It is certified that error appears in the above-identified patent and that said Letters Patent is hereby corrected as shown below:

Abstract page, Item [54], in the Title, Change "Electronic Or Acoustic, Passive Devices" to —Electronic Devices Or Acoustic Passive Devices—.

Col. 9, l. 46, delete "-".

Col. 13, l. 49, change "R4α" to —R4'—.

This certificate supersedes Certificate of Correction issued November 14, 1995.

Signed and Sealed this

Twenty-sixth Day of December, 1995

*Attest:*

Bruce Lehman

BRUCE LEHMAN

*Attesting Officer*

*Commissioner of Patents and Trademarks*